United States Patent [19]

Okada

[11] 4,138,042

[45] Feb. 6, 1979

[54] FUEL SUPPLYING APPARATUS HAVING A LINEARLY MOVABLE, CONSTANT HEIGHT HOSE UNIT

[75] Inventor: Kenji Okada, Tokyo, Japan

[73] Assignee: Tokico Ltd., Kawasaki, Japan

[21] Appl. No.: 861,501

[22] Filed: Dec. 16, 1977

[30] Foreign Application Priority Data

Dec. 18, 1976 [JP] Japan ..... 51-152364
Jun. 23, 1977 [JP] Japan ..... 52-74833

[51] Int. Cl.[2] ..... B67D 5/12

[52] U.S. Cl. ..... 222/529; 137/355.26; 248/75; 222/538

[58] Field of Search ..... 222/74, 75, 530, 538, 222/539, 527, 529; 137/355.16, 355.17, 355.20, 335.26, 355.23; 254/180 C; 248/75; 141/279, 284; 191/12 R, 12.2 R, 12.2 A

[56] References Cited

U.S. PATENT DOCUMENTS

| | | | |
|---|---|---|---|
| 2,578,036 | 12/1951 | Berke | 222/538 X |
| 2,893,422 | 7/1959 | Schiltz | 137/355.23 X |
| 2,896,659 | 7/1959 | Erickson | 137/355.23 X |
| 2,935,080 | 5/1960 | Klimek | 191/12 R X |
| 3,797,703 | 3/1974 | Yamawaki et al. | 222/74 X |
| 4,089,445 | 5/1978 | Tatsuno | 137/355.17 |

*Primary Examiner*—Allen N. Knowles
*Assistant Examiner*—Fred A. Silverberg
*Attorney, Agent, or Firm*—Haseltine, Lake & Waters

[57] ABSTRACT

A fuel supplying apparatus comprises a conduit pipe adapted to conduct a liquid fuel from a storage tank to a high place above a fuel supplying service area, a fuel supplying hose connected at one end thereof to the conduit pipe at its end at the high position and provided at the other free end thereof with a fuel supplying nozzle, the free end of the hose being suspended from the high place, an arm mechanism having one arm end pivoted at the high place and another arm end adapted to move in a straight line, the total length of the arm mechanism being substantially constant irrespective of the displacement position thereof, and a guide mechanism for guiding the other arm end of the arm mechanism in a substantially horizontal movement, that is, in a movement substantially parallel to the service area. One part of the hose is disposed substantially along the arm mechanism at the high place. The other part of the hose is suspended from the other arm end of the arm mechanism. The length of the other part of the hose is constant irrespective of paid-out position of the hose from the hose unit.

11 Claims, 7 Drawing Figures

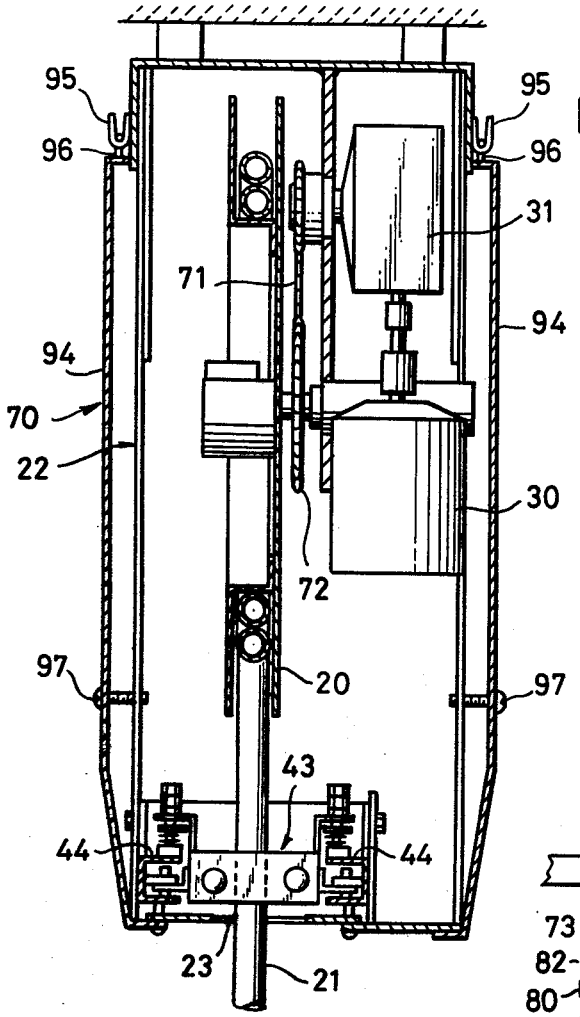
FIG. 6
FIG. 7
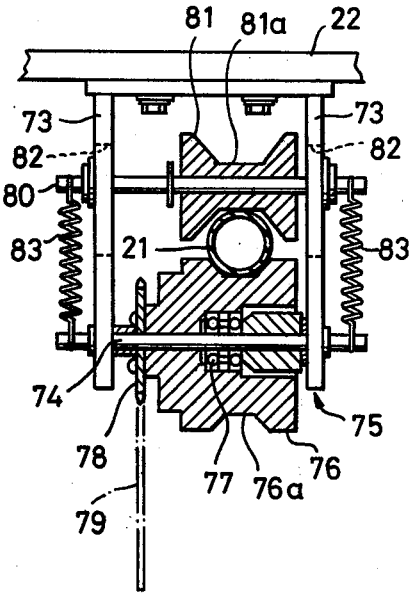

FUEL SUPPLYING APPARATUS HAVING A LINEARLY MOVABLE, CONSTANT HEIGHT HOSE UNIT

BACKGROUND OF THE INVENTION

The present invention relates generally to fuel supplying apparatuses and more particularly to improvements in fuel supplying apparatuses of the type wherein a hose unit secured to a structure above a fuel supplying service area of a fuel supplying station has a fuel supplying hose suspended downwardly therefrom.

Fuel supplying apparatuses of the so-called hanging or overhead type wherein a fuel hose is suspended from a hose unit called a delivery unit, which is secured to an architectural structure such as a ceiling or cross beam above a fuel supplying service area of a fuel supplying station, and fuel supplying is carried out through a fuel supplying nozzle connected to the lower end of the hose have heretofore been known.

In a fuel supplying apparatus of this type, the range wherein fuel supplying is possible is limited to an area corresponding to the base of a hypothetical cone which defines the movable range of the fuel hose and has its vertex at a hose paying-out aperture of the hose unit, the base of the cone being determined by the length of the hose. Accordingly, attempts have been made to expand the range wherein fuel supplying is possible so as to make possible fuel supplying also of vehicles and the like positioned outside of this range, and a number of apparatuses designed toward this end have been proposed.

In one example of these known fuel supplying apparatuses, an arm driven in horizontal rotation by a motor is provided under the hose unit, and a guide of ring shape for guiding the hanging part of the fuel hose which is inserted through the guide is provided at the outer end of this arm. In this apparatus, when the fuel supplying range is to be changed, the arm is driven in horizontal rotation by the motor thereby to cause the hanging part of the hose to be compulsorily moved by the guide rotating unitarily with the arm.

In this fuel supplying apparatus, however, since the guide undergoes an arcuate displacement together with the rotation of the arm, the fuel supplying nozzle at the lower end of the hose also undergoes an arcuate displacement (as viewed in plan view). For this reason, it is difficult to bring the rotational position the nozzle into coincidence with the optimum position for fuel supplying work, whereby the control of the swinging movement of the arm is troublesome.

It is known that in order to cause a material object to move to a desired position, in general, it is advantageous, human engineering-wise, to move the object linearly. Accordingly, a fuel supplying apparatus of an organization wherein the hose is moved with a linear movement to the optimum fuel supplying position has been proposed. In this apparatus, a hose paying out opening provided at the lower surface of a hose unit accommodating a reel around which the ose is wound is formed as a narrow and long opening of linear shape, and a truck capable of moving linearly along this opening is provided. The hose passes through the truck. The paid out position of the hose from the hose unit is determined by the position to which this truck has moved.

In this fuel supplying apparatus, however, as the paid-out position of the hose from the hose unit is displaced, the distance from a guide roller at a fixed position within the hose unit to the hose paid-out position varies. As a consequence, as the hose paid-out position is displaced, the height position of the nozzle at the lower end of the hose disadvantageously varies by a distance equal to the variation of the above mentioned distance.

In still another known fuel supplying apparatus, a truck is adapted to move linearly along a hose paying-out opening of a narrow long opening provided at the lower surface of a hose unit, and drive rollers for clamping the hose are mounted on this truck. This drive rollers rotate as they clamp the hose, which is being accommodated in a free state within a hose accomodating case provided in the hose unit, and thus carry out the operations of paying out and drawing in the hose. In this apparatus, even when the truck moves, the distance between the hose case and the truck is absorbed by the slack in hose which has been pulled out from the hose case. On the other hand, the length of the hose hanging from the drive rollers is constant irrespective of the position of the truck, and the height of the nozzle is also maintained constant.

However, in this fuel supplying apparatus, since the motive power source for driving the drive rollers must unavoidably be mounted on the truck, the total weight of the truck is large. For this reason, when the operator moves the hanging point of the hose, a very great force is necessary for the operator to pull the hose sidewards and to move the truck via the hose, whereby the load on the operator is large. Furthermore, since the raising and lowering of the hose is being carried out by the drive rollers, slippage between the hose and drive rollers occurs when the hose is contaminated by a substance such as oil, whereby positive and accurate raising and lowering of the hose cannot be carried out. In addition, there are other problems such as rapid wear or damage of the hose because it is continually being clamped under pressure by the drive rollers acting on its side surface.

SUMMARY OF THE INVENTION

Accordingly, it is a general object of the present invention to provide a novel and useful fuel supplying apparatus in which the above described problems encountered in prior-art apparatuses are overcome.

Another and specific object of the invention is to provide a fuel supplying apparatus of a structural arrangement such that the suspended position of the hose hanging from a hose unit can be moved linearly with the height of the nozzle maintained constant. A feature of the fuel supplying apparatus of the invention is that, even when the paid-out position of the hose from the hose unit is changed, the length of the hose from a hose reel, around which the hose is wound, to the hose paid-out position of the hose unit undergoes substantially no variation. Furthermore, since a motive power source is not mounted on the truck for changing the paid-out position of the hose, as in the known apparatus, the truck can be moved by a very small force, and the paid-out position, that is, the hanging position, of the hose can be easily changed.

Still another object of the invention is to provide a fuel supplying apparatus in which, in addition to the above stated features, the unwinding and winding up of the hose are accomplished smoothly without slackening of the hose.

Other objects and further features of the invention will be apparent from the following detailed description with respect to preferred embodiments thereof when read in conjunction with the accompanying drawings.

BRIEF DESCRIPTION OF THE DRAWINGS

In the drawings:

FIG. 6 is an elevation, in vertical section, which is orthogonal to the side elevation in FIG. 5; and FIG. 7 is an enlarged section taken along the vertical plane indicated by line VII—VII in FIG. 5.

DETAILED DESCRIPTION

Figure 1:
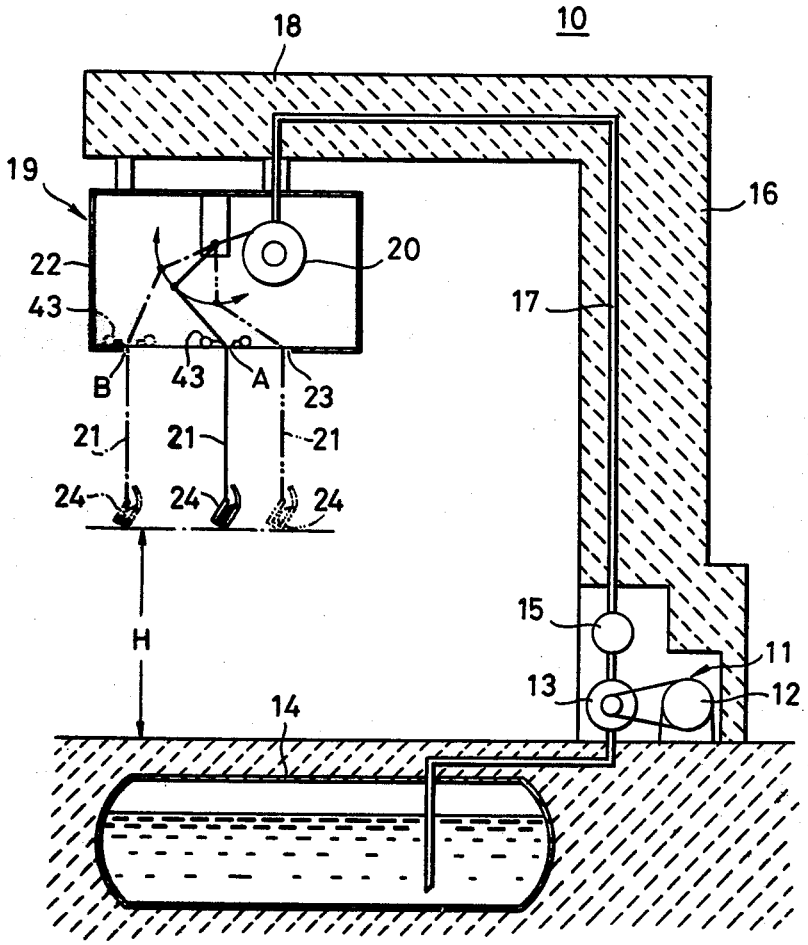
FIG. 1 is a simplified schematic elevation showing the principal parts of a first embodiment of the fuel supplying apparatus according to the present invention.

In the fuel supplying apparatus 10 in FIG. 1, a pump unit 11 is installed at a position where it will not be in the way of moving vehicles. The pump unit 11 has a pump 13 driven by a motor 12 and thus operated to pump up liquid fuel from an underground tank 14 and to deliver this fuel through a flow meter 15 and upward through a fixed conduit pipe 17 extending upward through a building structure 16. The conduit pipe 17 extends further through an elevated structure 18 such as a ceiling or cross beam projecting over a fuel supplying service area of a fuel supplying station and, at its terminal end, is connected to the upstream end of a fuel supplying hose 21 wound around a hose reel 20 rotatably supported within a hose unit 19 secured to the elevated structure 18.

The hose reel 20 is adapted to unwind the hose 21, which is guided by an arm mechanism described hereinafter and is thus paid out through an opening 23 comprising a straight slotlike hole provided in the bottom of a casing 22 of the hose unit 19, a specific length of the free end of the hose 21 thereby being suspended from the opening 23. A fuel supplying nozzle 24 is connected to the extreme free end of the hose 21.

Figure 2:
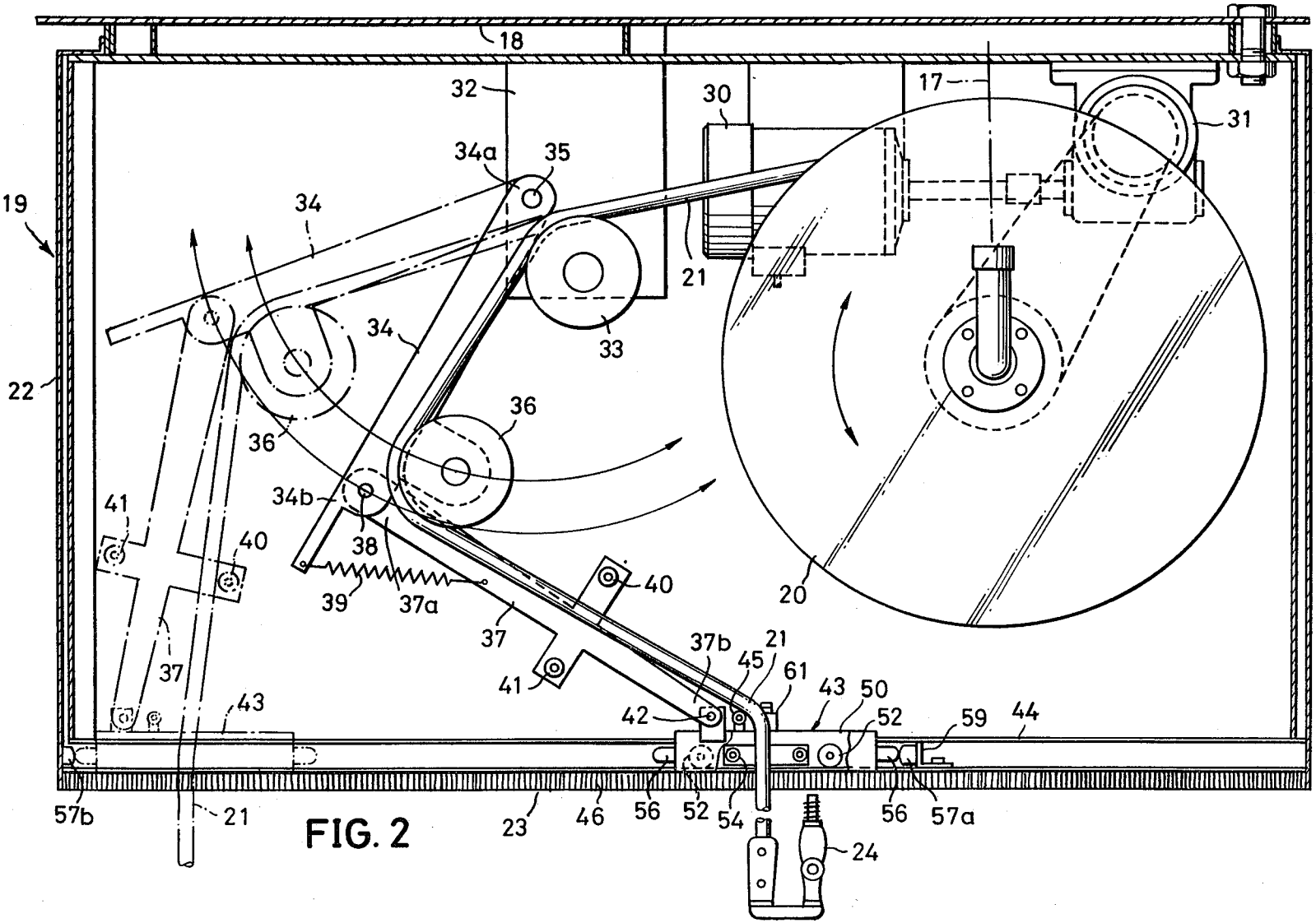
FIG. 2 is a side elevation, partly in vertical section, of an essential component of the apparatus illustrated in FIG. 1.

The mechanical organization of the parts within the hose unit 19 constituting an essential component of the fuel supplying apparatus of the invention will now be described with reference to FIG. 2. The above mentioned hose reel 20 is driven by a motor 30 through a speed reducing mechanism 31 in a forward or a reverse direction thereby to unwind or wind up the hose 21. The hose 21 unwound from the hose reel 20 is first guided and changed in its path direction by a first guide roller 33 which is rotatably supported on a support structure 32 fixed to the inner part of the casing 22.

A first arm 34 is pivoted at one end **34*a* thereof by a pin 35 on the support structure 32 and, at a part thereof in the vicinity of its other free end, rotatably supports a second guide roller 36 around which the hose 21 is further passed. One end 37*a* of a second arm 37 is pivoted by a pin 38 on the free end 34*a* of the first arm 34. The end 34*a* of the first arm 34 has a further extension to an extreme end, between which and an intermediate part of the second arm 37 a tension spring 39 is provided. The second arm 37 has, at another intermediate part thereof, a pair of oppositely extending lateral projections, on the outer ends of which rollers 40 and 41, respectively, are rotatably supported. The other free end 37*b* of the second arm 37 is pivotally connected by a pin 42 to a truck 43**.

This truck 43 rides, as described more fully hereinafter, on two parallel rails 44 fixedly laid on the lower part of the casing 22 parallel to and on the opposite sides of the opening 23. Dust-proofing brushes 46 are provided respectively along the opposite edges of the opening 23 at the bottom of the casing 22.

Figure 3:
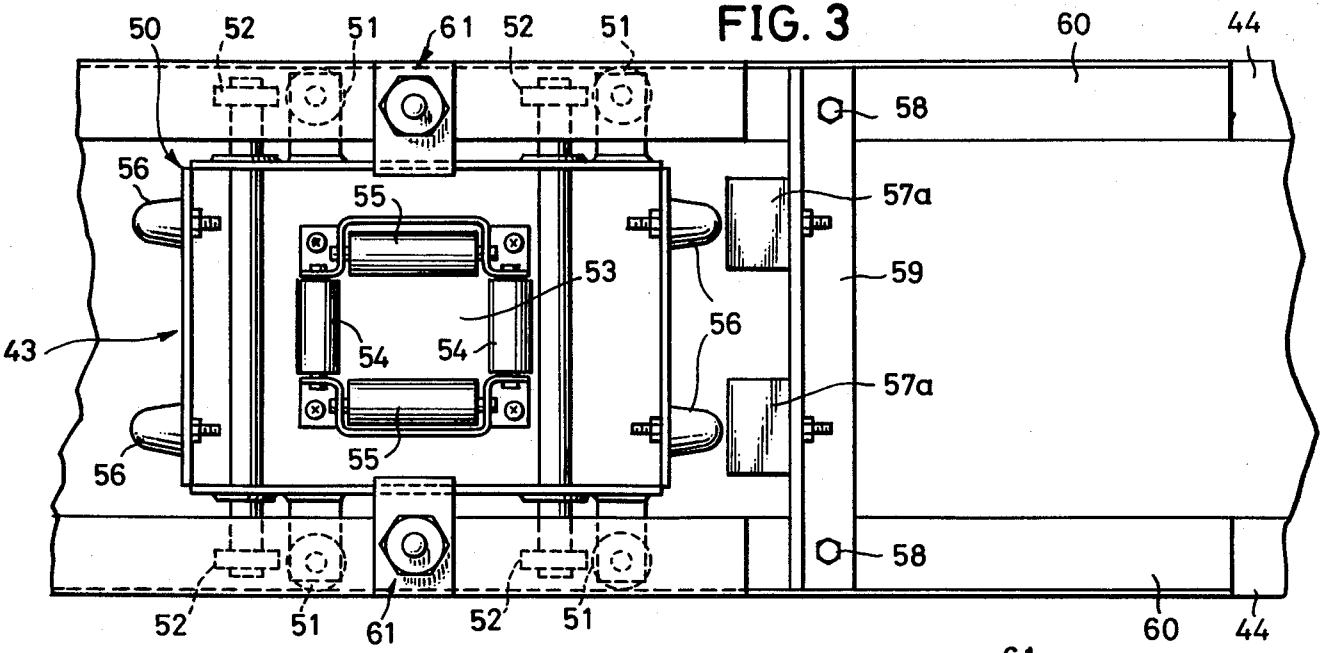
FIG. 3 is a plan view of a truck and parts related thereto in the component shown in FIG. 2.
Figure 4:
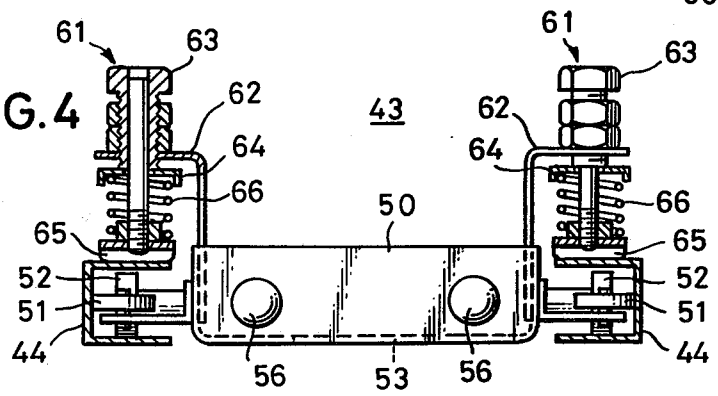
FIG. 4 is an end elevation of the truck and related parts shown in FIG. 3.

The truck 43 is shown in detail in FIGS. 3 and 4. The truck 43 has a chassis 50, which rotatably supports a set of four rollers 51 rotatable about vertical axes and a set of four rollers 52 rotatable about transverse horizontal axes. The rollers 51 are adapted to contact and roll along the inner side surfaces of the web parts of the rails 44, which are of channel shape and are disposed with their open sides facing each other. The rollers 52 are adapted to roll along the inner surface of the lower flanges of the rails 44. The truck chassis 50 has at its center a square opening 53, along the edges of which are rotatably supported two pairs of opposed rollers 54 and 55.

The truck chassis 50 is further provided on its opposite transverse ends, that is, the ends facing the directions of its travel, with respective pair of cushioning members 56. These cushioning members 56 are adapted to butt in a shock-absobing manner against corresponding buffer members **57*a* and 57*b* respectively provided at limiting positions of the range of travel of the truck 43 thereby to absorb impact loads at the limiting positions. The buffer members 57*a* are mounted on a transverse stop beam 59 fixed at the ends by bolts 58 to the two rails 44. The truck 43 can be separated from the hose unit for repairs or other work by removing the bolts 58 thereby to disconnect the stop beam 59, moving the truck 43 to a recessed part 60 of the rails 44 where the upper flanges thereof are cut out, and lifting the truck 43 up and out from the rails 44**.

The truck 43 is further provided on opposite sides thereof with respective brake mechanisms 61. Each brake mechanism 61 comprises an upright pressure-adjusting bolt 63 which is mounted on a bracket 62 fixed to the truck chassis 50, a spring retainer 64 connected to the bolt 63, a friction pad 65 for contacting the upper surface of the corresponding rail 44, and a coil spring 66 provided between the spring retainer 64 and the friction pad 65 and around the lower part of the bolt 63. By rotating the press-adjusting bolt 63, the spring retainer 64 is moved up and down, and the contact pressure due to the force of the spring 66 with which the friction pad 65 is pressed against the upper surface of the rail 44 is adjusted. Thus, the frictional resistance force of the friction pad 65 relative to the rail 44 with respect to the direction of travel of the truck 43 is readily adjusted to a suitable value.

The hose 21 unwound from the hose reel 20 is guided by the guide rollers 33 and 36, is further guided by rollers 45, 54, and 55 provided on the truck 43, passes through the central hole 53 of the truck 43 and the opening 23 of the casing 22, and assumes a state of suspension from the hose unit 19.

In its winding-up operation, the hose reel 20 winds up the hose 21 to an extent where a specific length of the hose at its outer free is still hanging from the hose unit 19, and the nozzle 24 is at a specific high position. When the nozzle 24 is to be lowered, the motor 30 is operated to rotate the reel 20 in the counterclockwise direction as viewed in FIG. 2. Together with the unwinding rotation of the reel 20, the hose 21 is unwound from the reel 20 and, guided by the rollers 33 and 36 and the rollers 45, 54, and 55 of the truck 43, is further paid out from the hose unit 19, the nozzle 24 thereby descending. When the nozzle 24 has thus descended to a specific height H, the motor 30 is stopped to stop the rotation of the reel 20.

Then, in the case where a vehicle to be supplied with fuel is stopped at a position to the left of that of the nozzle 24 shown by full line in FIG. 1, the hose 21 is pulled toward the left. The hose therefore exerts a force on the truck 43, which thereupon moves smoothly, riding on the rollers 51 and 52, toward the left as viewed in the drawing to a position, for example, as indicated by one-dot chain line. As the truck 43 thus moves from the position A indicated by full line to the position B indicated by one-dot chain line, the arm 34 is pushed by the arm 37 having one end part **37*b* thereof pivoted on the truck 43 and rotates clock-wise about the pivot pin 35**.

During this operation, the arm 37, in a state wherein its two ends are respectively pivoted on the truck 43 and the arm 34, also undergoes rotational displacement relatively to the arm 34. As a consequence, the end part **34*a* of the arm 34, being pivoted on the support structure 32, the end part 37*b* of the arm 37 being pivoted on the truck 43, and, moreover, the arms 34 and 37 being mutually maintained in a state wherein their end parts 34*b* and 37*a* are pivoted, the arms 34 and 37 assume rotationally displaced positions corresponding to the travel position of the truck 43**.

Accordingly, irrespective of the travel position of the truck 43, that is, irrespective of the rotational displacement positions of the arms 34 and 37, the sum of the lengths of the arms 34 and 37 is constant. The hose 21 within the hose unit 19, being guided by the guide rollers 33 and 36 and the rollers 45 and 54, etc., of the truck 43, is extended substantially along the arms 34 and 37 irrespective of the rotational displacement positions of the arms 34 and 37. Consequently, regardless of the travel position of the truck 43, the length of the hose 21 from the hose reel 20 up to the central hole 53 of the truck 43 is substantially constant. For this reason, no matter to what position the truck 43 is moved along the rails 44, the length of the hose 21 hanging from the hose unit 21 is constant, and the nozzle 24 is maintained at a constant height H. Similar is the case where the hose 21 and the nozzle 24 are moved rightwards.

By appropriately selecting the contact pressure with which the pad 65 of the brake mechanism 61 presses on the rails 44, a suitable frictional resistance force is imparted to the truck 43 during its travel. For this reason, after the truck 43 has been moved through the hose 21, the truck 43 maintains its stopped state at the desired travel position and cannot be unnecessarily moved.

The control of the modes of operation of the motor 30 such as forward rotation, reverse rotation, and stopping may be accomplished by manipulating a switch provided on the wall surface of the building structure 16 at a position at which it can be manually reached by the operator. Alternatively, the motor 30 may be controlled by a switch provided within the hose unit 19 or at the nozzle 24 and actuated by pulling a control cord secured at one end thereof to the switch and hanging with a length such that its lower end can be manually reached by the operator.

Figure 5:
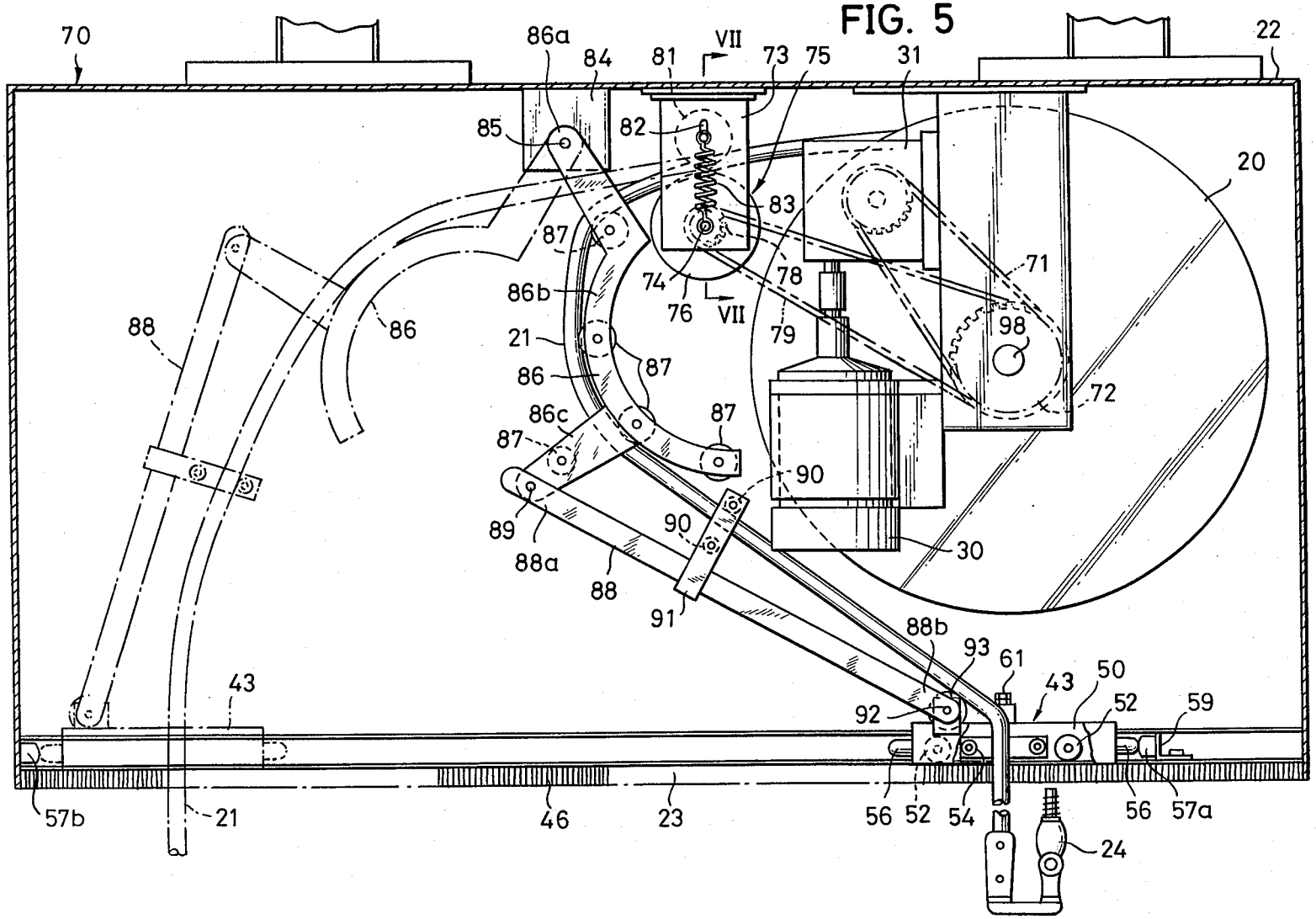
FIG. 5 is a side elevation, partly in vertical section, of an essential component of a second embodiment of the fuel supplying apparatus according to the invention.

A second embodiment of the fuel supplying apparatus of the invention will now be described with reference to FIGS. 5, 6, and 7. In FIG. 5, those parts which are the same as corresponding parts in FIG. 2 are designated by like reference numerals, and description of such parts will be omitted.

Referring to FIGS. 5, 6, and 7, the casing 22 of the hose unit 70 of the present second embodiment of the invention accommodates a motor 30, a hose reel 20, and a power transmission mechanism comprising a speed reducing mechanism 31, an endless chain 71, and sprocket wheels including a sprocket 72 for transmitting driving power from the motor 30 to the hose reel 20. A driving roller 76 constituting a driving mechanism 75 is rotatably supported through a bearing 77 on a horizontal shaft 74, which is supported by a bracket 73 fixed to the casing 22. The driving roller 76 has around its rim an annular groove **76*a* for receiving therein the fuel hose 21 and made of a material such as Duracon (tradename) resin so as to permit an appropriate degree of slippage of the hose 21. This driving roller 76 is driven by power transmitted from the motor 30 through the above mentioned sprocket 72 and an endless chain 79 passed around the sprocket 72 and a sprocket 78 fixed coaxially to the driving roller 76**.

A follower roller 81 having an annular peripheral groove **81*a* for contacting the hose 21 is rotatably supported on a substantially horizontal shaft 80 which at its ends is passed through an slidably engaged with slots 82 provided in the bracket 73. This follower roller 81 is thus disposed above the driving roller 76 on the opposite side of the hose 21 from the driving roller 76, the shafts 74 and 80 being substantially parallel to each other. Tension springs 83 are stretched between the corresponding ends of these shafts 74 and 80. The follower roller 81 is thereby urged toward the driving roller 76 by the force of the springs 83 and thus presses the hose 21 with an appropriate force against the driving roller 76**.

A first arm 86 is pivoted at its one end **86*a* by a pin 85 on another bracket 84 fixed to the casing 22. This first arm 86 has a curved part 86*b* and a projecting part 86*c* extending from an intermediate part of the curved part 86*b*. The curved part 86*b* and the projecting part 86*c* are provided with a plurality of hose guide rollers 87 rotatably supported thereon. To the outer end of the projecting part 86*c* of the arm 86 is pin connected one end 88*a* of a second arm 88 by a pin 89. At an intermediate part of the second arm 88, there is mounted a support means 91 rotatably supporting hose guide rollers 90. The other end 88*b* of the second arm 88 is pivoted by a pin 92 on the truck 43. A hose guide roller 93 is further supported rotatably on the pin 92**.

As is apparent from FIG. 6, the casing 22 comprises relatively thin wall parts. The casing 22 has two decorative panels 94 covering its sides, which panels are suspended by hooks 96 fixed to their upper edges and engaged with hangers 95 fixed to the upper part of the casing, the lower part of the panels 94 being secured to the casing by screws 97. To remove a panel 94, its screws 97 are loosened, and its hooks 96 are disconnected from their hangers 95, whereupon the panel can be easily removed from the casing 22.

The hose 21 unwound from the hose reel 20 is guided by the driving roller 76, the follower roller 81, and the guide rollers 87 and 90 and is further guided by the rollers 93, 54, and 55 provided on the truck 43 to pass through the central hole of the truck 43 and the opening 23 of the casing 22 thereby to hang from the hose unit 70.

To lower the nozzle 24 at the lower end of the hose 21, the motor 30 is operated to rotate the hose reel 20 in the counterclockwise direction as viewed in FIG. 5 thereby to unwind the hose 21 from the reel 20. The hose 21 thus unwound is guided by the above mentioned rollers 76, 81, 87, 90, 93, 54, 55, etc., to be paid out from the hose unit 70, whereby the nozzle 24 descends.

When, as the reel 20 is rotated and the hose 21 is being unwound, the nozzle 24 is grasped by the operator and thus placed in a state wherein its descent is obstructed, the smooth lowering of the hose 21 is hindered. In this case, if the driving roller 76 does not exist, the hose 21 will not be positively unwound from the reel 20 but will slacken around the reel 20. As a consequence, there will arise the possibility of the hose rubbing against the inner surface of the casing 22 and becoming damaged or being wrapped around the support shaft 98 of the reel 20.

In the present embodiment of the invention, however, the driving roller 76 is provided and is adapted to rotate together with the reel 20. For this reason, the hose 21 is pulled and tensioned by the driving roller 76 at the time when the reel 20 is rotating, and its portion wound around the reel 20 does not undergo slackening and is positively unwound from the reel 20. Therefore, the above described undesirable occurrences during unwinding are prevented.

Then, in order to move the nozzle 24 position toward the left, for example, as viewed in FIG. 5, the hose is pulled toward the left, the truck 43 is pulled by the hose 21 and travels leftwards. In this operation, the first arm 86 is pushed by the second arm 88 pivoted at its end 88*b* on the truck 43 and rotates counterclockwise as viewed in FIG. 5. Accordingly, the arms 86 and 88 assume rotational displacement positions conforming to the travel position of the truck 43 with the mechanism in a state wherein the end 86*a* of the first arm 86 is pivotally supported on the bracket 84, while the end 88*b* of the second arm 88 is pivotally connected to the truck 43, and, at the same time, the projection 86*c* of the first arm 86 is pin connected to the end 88*a* of the second arm 88.

Consequently, the path of the hose 21 substantially along the first and second arms 86 and 88 is substantially unchanged irrespective of the rotational displacement position of the arms 86 and 88. For this reason, the length of the hose 21 suspended from the hose unit 70 is constant irrespective of the travel position of the truck 43, whereby the nozzle 24 is maintained at a constant height.

Further, this invention is not limited to these embodiments but various variations and modifications may be made without departing from the scope and spirit of the invention.

What is claimed is:

1. A fuel supplying apparatus comprising:

a conduit pipe adapted to conduct a liquid fuel from a storage tank to a high place above a fuel supplying service area;

a fuel supplying hose connected at one end thereof to the conduit pipe at its end at the high position and provided at the other free end thereof with a fuel supplying nozzle, the free end of the hose being suspended from the high place;

an arm mechanism having one arm end pivoted at the high place and another arm end adapted to move in a straight line, the total length of the arm mechanism being substantially constant irrespective of the displacement position thereof, one part of the hose being disposed substantially along the arm mechanism at the high place, the free end of the hose being suspended from the other arm end of the arm mechanism; and a guide mechanism for guiding the other arm end of the arm mechanism in a substantially horizontal movement, that is, in a movement substantially parallel to the service area.

2. A fuel supplying apparatus as claimed in claim 1 which further comprises a building structure extending above the service area, said conduit pipe being installed within the building structure, and a hose unit having a casing and installed in a secured state to the building structure at the high place, said arm mechanism being accommodated within the casing, said guide mechanism being installed at the lower part of the casing.

3. A fuel supplying apparatus as claimed in claim 2 which further comprises a hose reel rotatably supported within the casing with the hose wound therearound and motive power means for driving the hose reel in forward and reverse directions thereby to unwind or wind up the hose.

4. A fuel supplying apparatus as claimed in claim 3 which further comprises a driving roller mechanism for actively driving the hose unwound from the hose reel.

5. A fuel supplying apparatus as claimed in claim 4 in which the driving roller mechanism is disposed between the hose reel and the arm mechanism and has a mechanism to which the rotation of the hose reel is transmitted.

6. A fuel supplying apparatus as claimed in claim 1 in which said arm mechanism comprises a first arm having the one arm end pivoted at the high place and a second arm pivotally connected to the first arm and having the other arm end adapted to move in a straight line, said first arm being caused to rotate about the one arm end and said second arm being caused to undergo a rotational displacement relatively to the first arm by the straight line movement of the other arm end.

7. A fuel supplying apparatus as claimed in claim 6 in which said first arm has a plurality of guide rollers for guiding the hose in one portion thereof in a curved path.

8. A fuel supplying apparatus as claimed in claim 1 in which said arm mechanism has guide rollers for guiding the hose so that one part thereof moves substantially along the arm mechanism.

9. A fuel supplying apparatus as claimed in claim 1 in which said guide mechanism comprises straight rails fixed substantially horizontally at the high place and a truck adapted to travel freely along the rails and pivotally supporting the other arm end of the arm mechanism.

10. A fuel supplying apparatus as claimed in claim 9 in which said rails comprises a pair of rails of a channel-shaped cross section with opposing opening sides with each other, and said truck has rollers adapted to contact and roll along the rails within the space formed by and between the flanges and web of each rail.

11. A fuel supplying apparatus as claimed in claim 9 in which said truck is provided with a brake mechanism for generating a suitable frictional resistance force with respect to the rails.

* * * * *